US006102127A

United States Patent [19]

Pierce

[11] Patent Number: 6,102,127

[45] Date of Patent: Aug. 15, 2000

[54] TEMPERATURE CONTROLLED VALVE FOR DRIP VALVES AND SPRINKLER SYSTEMS

[76] Inventor: Lauvon Pierce, Rte. 1 Box 122, Leakesville, Miss. 39451

[21] Appl. No.: 09/121,581

[22] Filed: Jul. 24, 1998

Related U.S. Application Data

[63] Continuation-in-part of application No. 08/990,188, Dec. 12, 1997.

[51] Int. Cl.[7] ..... A62C 37/08

[52] U.S. Cl. ..... 169/37

[58] Field of Search ..... 239/75; 169/38, 169/57, 37, 39, 40, 41; 137/79, 468; 251/324, 325, 282

[56] References Cited

U.S. PATENT DOCUMENTS

| | | | |
|---|---|---|---|
| Re. 29,155 | 3/1977 | Mears et al. . | |
| 1,122,928 | 12/1914 | Hodges | 251/325 |
| 2,656,144 | 10/1953 | Frantz | 251/324 |
| 2,667,927 | 2/1954 | Johnston | 251/325 |
| 3,635,249 | 1/1972 | Kirkman | 251/32 |
| 3,734,191 | 5/1973 | Johnson et al. . | |
| 3,853,146 | 12/1974 | Blair | 251/324 |
| 4,258,795 | 3/1981 | Hansen | 137/79 |
| 4,537,182 | 8/1985 | Otani | 251/325 |
| 4,638,828 | 1/1987 | Barrineau | 137/79 |
| 4,784,173 | 11/1988 | Carney | 137/79 |
| 4,805,700 | 2/1989 | Hoover . | |
| 4,899,825 | 2/1990 | Bosoni et al. . | |
| 5,183,116 | 2/1993 | Fleming . | |
| 5,441,113 | 8/1995 | Pierce . | |
| 5,575,338 | 11/1996 | Sundholm . | |
| 5,667,017 | 9/1997 | Hoffman et al. . | |

FOREIGN PATENT DOCUMENTS

| | | | |
|---|---|---|---|
| 440945 | 10/1948 | Italy | 251/325 |
| 2183123 | 10/1984 | United Kingdom | 137/79 |

*Primary Examiner*—Kevin Weldon
*Attorney, Agent, or Firm*—Richard C. Litman

[57] ABSTRACT

A temperature sensitive valve, used in drip valves and sprinkler heads includes a core housing the temperature sensitive valve and has a supply conduit entering through the top surface of the core. The temperature sensor activates a motor when the temperature is outside a predetermined range which in turn pushes an activating rod. A piston is attached to the rod. The piston moves from a retracted sealed position to an extended open position which allows fluid to pass around the piston and to an output port which leads to a disposal area or a sprinkler head. The fluid is allowed to flow beyond the piston due to an enlarged diameter section of the core. Alternatively, a piston having an internal channel with an exit hole is aligned with the output port when the piston is in the extended position. Fluid enters the piston channel and passes through the exit hole and through the output port. The valve is most useful in drip valve installments and sprinkler systems.

2 Claims, 3 Drawing Sheets

TEMPERATURE CONTROLLED VALVE FOR DRIP VALVES AND SPRINKLER SYSTEMS

CROSS-REFERENCE TO RELATED APPLICATION

This application is a continuation in part of pending U.S. patent application Ser. No. 08/990,188 filed Dec. 12, 1997.

BACKGROUND OF THE INVENTION

1. Field of the Invention

The present invention relates to drip valves and more particularly to temperature controlled drip valves.

2. Description of the Related Invention

Many fire extinguishing systems that dispense water and/or fire fighting foams, use sprinkler heads to deliver the fire fighting material. The sprinkler heads often contain a temperature sensitive actuator that opens a valve within the sprinkler head when the temperature sensed exceeds a predetermined set-point. The present invention provides a simple but effective valve for these types of sprinkler heads. The valve is also easily adapted for use in drip valve installments for preventing the build-up of freezing or scalding fluid within the system.

U.S. Pat. No. 3,734,191, issued on May 22, 1973 to Johnson, et al., shows a temperature controlled sprinkler head assembly having a spring biased closure. A temperature sensitive actuator controls a simple valve within the sprinkler head. U.S. Pat. No. Re. 29,155 issued on Mar. 22, 1977 to Mears et al., discloses an on-off sprinkler with a valve controlled by a bimetal disc actuator. The actuator has a snap action and hysteresis for providing a thermal delay upon closing the valve. U.S. Pat. No. 4,899,825, issued on Feb. 13, 1990 to Bosoni, et al., describes a fire extinguishing system wherein a foam-water mixture is supplied via a single conduit to a user device. Volumetric pumps proportionally meter fire fighting foam based on the flow of fire fighting water. U.S. Pat. No. 5,183,116, issued on Feb. 2, 1993 to Fleming shows a variable pressure regulator that controls the flow rate of fire extinguishing material to a discharge nozzle. A pressure sensitive valve includes a piston body with an O-ring seal that regulates the flow of the fire extinguishing material based on the pressure of the material.

Other devices related to fire fighting systems, but less related to the valved system of the present invention are known, including U.S. Pat. No. 5,667,017 (atomizer for generating water-mists in fire-fighting systems) issued Sep. 16, 1997 to Hoffman et al.; U.S. Pat. No. 4,805,700 (foam generator adjustable to produce foam having various expansion ratios) issued Feb. 21, 1989 to Hoover; and U.S. Pat. No. 5,575,338 (valve for fire fighting installation) issued Nov. 19, 1996 to Sundholm.

The most pertinent related art device is disclosed in U.S. Pat. No. 5,441,113, issued on Aug. 15, 1995 to Pierce, (the present inventor) and this patent is hereby incorporated by reference. The fire extinguishing system described in this patent uses a sprinkler head having a shuttle valve that is operated by a bimetallic disc. The present invention improves upon this sprinkler head by using a valve having a simpler and more effective sealing arrangement.

None of the above inventions and patents, taken either singularly or in combination, is seen to describe the instant invention as claimed. Thus a sprinkler head solving the aforementioned problems is desired.

SUMMARY OF THE INVENTION

The present invention is directed to a temperature sensitive valve, a drip valve, and a sprinkler head operated by the valve. A core houses the temperature sensitive valve of the present invention and has a fluid supply conduit entering through the top surface thereof. It should be noted that the term "fluid" is intended to include water, fire fighting foam, and any other material that flows and can be controlled by valving arrangements.

A cylindrical core defines an internal cavity which houses the working parts of the valve. The core has a sidewall that in several embodiments defines a large diameter section and a narrow diameter section. A piston is slidably mounted within the cavity creating a seal therewith by two sealing discs on either end of the piston. Movement of the piston between a retracted, sealed, position, and an extended, open, position is accomplished by a motor attached to the piston via an activating rod. The motor is actuated by a temperature sensor. Depending upon the application, the temperature sensor determines the ambient temperature or the fluid temperature. Sprinkler embodiments work based upon the ambient temperature while drip valve installments operate on the temperature of the fluid within the system.

The drip valve installment allows fluid from within the system to be drained and replaced by fluid from a source or reservoir having a more desirable temperature. Use of the valve prevents pipes from freezing since the valve opens to drain fluid at or near the freezing point. The valve also prevents scalding since the valve opens to drain fluid at or above a predetermined high "scalding" point. All fluids exit the core via an output port which may lead to another pipe or some other disposal means.

The sprinkler installment is attached to the ceiling in-line with a fire fighting fluid system. The valve works in generally the same fashion, but exits to a spray nozzle for reaching a wider area.

Accordingly, it is a principal object of the invention to provide a improved seal and smooth operation.

It is a further object of the invention to provide a drip valve having an improved seal and smoother operation.

It is a further object of the invention to provide a sprinkler head and valve having an improved seal and smoother operation.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
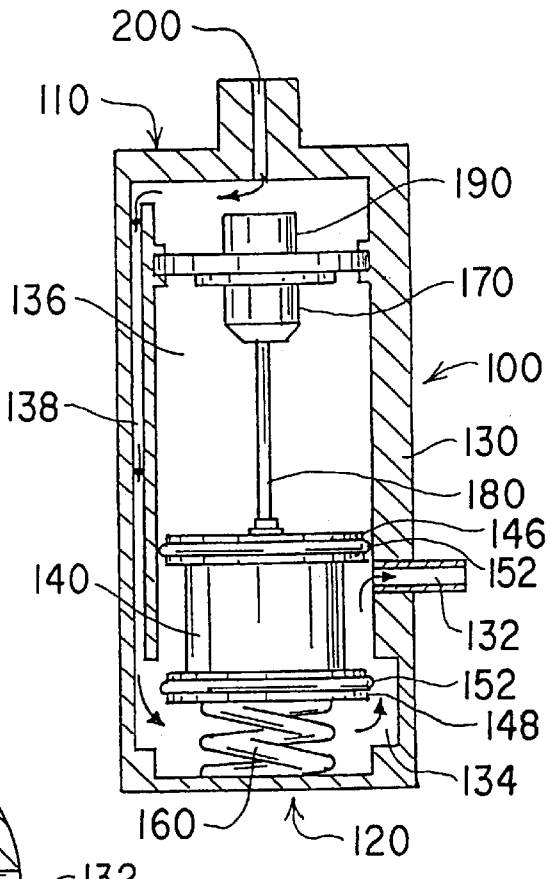
FIG. 2 is a detail view, partly in cross section, of the valve of FIG. 1 in an open position.

The present invention is a temperature controlled valve for associated use in a drip valve or sprinkler head. Common to all embodiments of the invention are a temperature sensor 190, an associated heat motor 170, an actuating rod 180, a piston, and a cylindrical core 100 having an output port 132.

Figure 4:
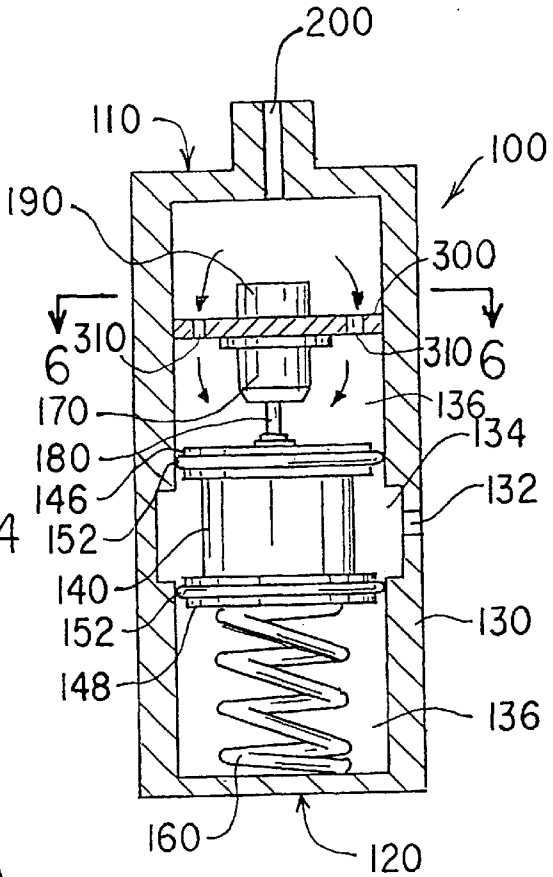
FIG. 4 is a detail view, partly in cross section, of another embodiment of a valve in a drip valve installation of the present invention, shown in a closed position.
Figure 6:
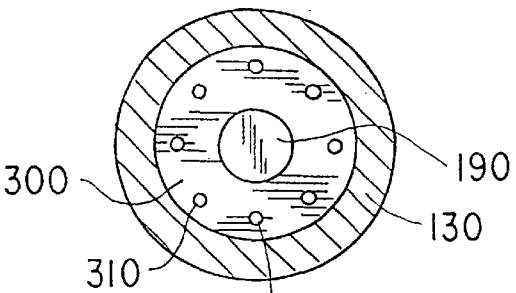
FIG. 6 is a plan cross-sectional view taken along line 6—6 of FIG. 4 of a valve in a drip valve installation of the present invention.
Figure 5:
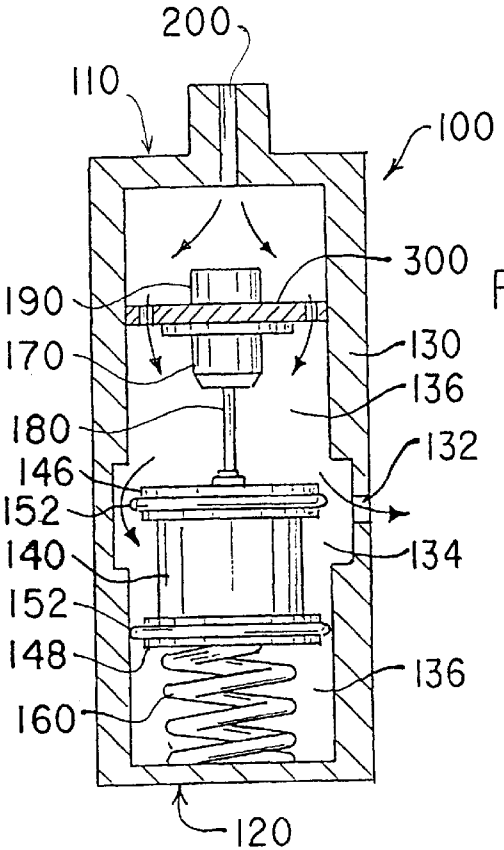
FIG. 5 is a detail view, partly in cross section, of the valve of FIG. 4 in an open position.

Drip valve installations using the valve prevent the freezing of pipes or the build-up of scalding fluid within the system. FIG. 4 illustrates a basic drip valve assembly in a closed position, the corresponding open position is shown in FIG. 5. A cylindrical core 100 having a top 110 and a bottom 120 connected by a vertical sidewall 130 is connected to the fluid system by a fluid supply conduit 200 attached to the top 110 of the core 100. An internal cylindrical cavity is defined by the core 100 top 110, bottom 120, and sidewall 130. The internal cavity has a large diameter section 134 and a narrow diameter section 136. The large diameter section 134 is created by reducing the width of the core sidewall 130. As shown in FIGS. 4 and 5, the large diameter section 134 is preferably located at substantially the midpoint of the internal cavity. The output port 132 is created by a hole passing completely through the sidewall 130 at a point within the large diameter section 134. The output port 132 may be attached to a sprinkler head, another hose or pipe, or other disposal means.

The output port 132 is sealed against fluid flow by the piston. The piston consists of a main piston body and first and second sealing discs 146, 148. The sealing discs have a diameter substantially equal to that of the narrow diameter section 136, while the main body 140 has a further reduced diameter. To facilitate a better seal, each sealing disc may be fitted with an O-ring 152. The piston is slidably mounted within the cavity for movement between a sealed position and an open position. In a first retracted, sealed, position, the sealing discs engage the sidewall 130 of the narrow diameter section 136 on either side of the large diameter section 134 thus sealing the output port 132 from fluid flow, as shown in FIG. 4. In a second extended, open, position the first sealing disc 146 disengages the narrow diameter section 136 and enters the large diameter section 134 thus allowing fluid to flow into the large diameter section 134 and subsequently through the output port 132. The second sealing disc 148 remains in contact with the narrow diameter section 136 and is used to guide the piston helping to maintain coaxial alignment between the piston and the cavity. A compression spring 160 may also be used to bias the piston into a retracted, closed, position.

Movement of the piston between the retracted closed position and the extended open position is governed by a motor 170 actuated by a temperature sensor 190. An actuating rod 180 is used to connect the first sealing disc 146 of the piston to the motor 170. The motor 170 is in turn operatively connected to the temperature sensor 190. The temperature sensor 190 is mounted within the cavity near the core top 110 positioned to sense the temperature of fluid entering the cavity through a supply conduit 200. FIG. 4 shows the sensor 190 mounted by a plate 300 having a plurality of apertures 310 which allows the fluid to surround and pass about the sensor 190 and motor 170 until it is either stopped by a closed piston or released through the output port 132. The temperature sensor 190 may be made in a variety of ways. The sensor 190 may activate the motor 170 when the temperature nears freezing, near scalding, or both. In a preferred embodiment, the motor 170 will be activated if the temperature falls outside the range of approximately 35° F. to approximately 105° F. Most preferably, the valve will begin to open at temperatures of between 40°–45° and 95° and fully open at 35° F. and 105° F. The opening of the valve allows fluid to exit the system to be replaced with fluid at a "normal" temperature, thus preventing unwanted damage to pipes and people.

This valve may also be used in a sprinkler type arrangement, where the temperature sensor 190 is mounted externally for sensing the ambient temperature. This particular embodiment is most useful with fire-fighting fluids.

Figure 3:
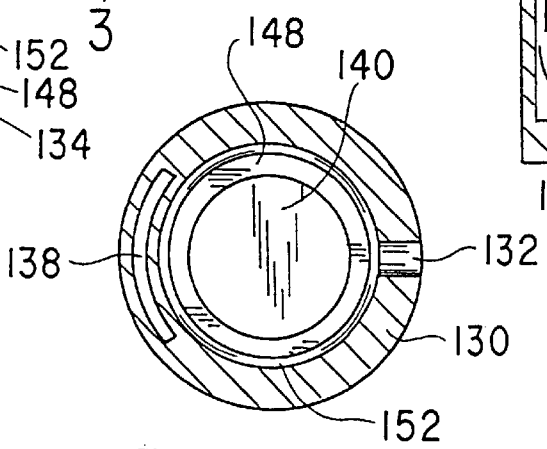
FIG. 3 is a plan cross-sectional view taken along line 3—3 of FIG. 1 of a valve in a drip valve installation of the present invention.
Figure 1:
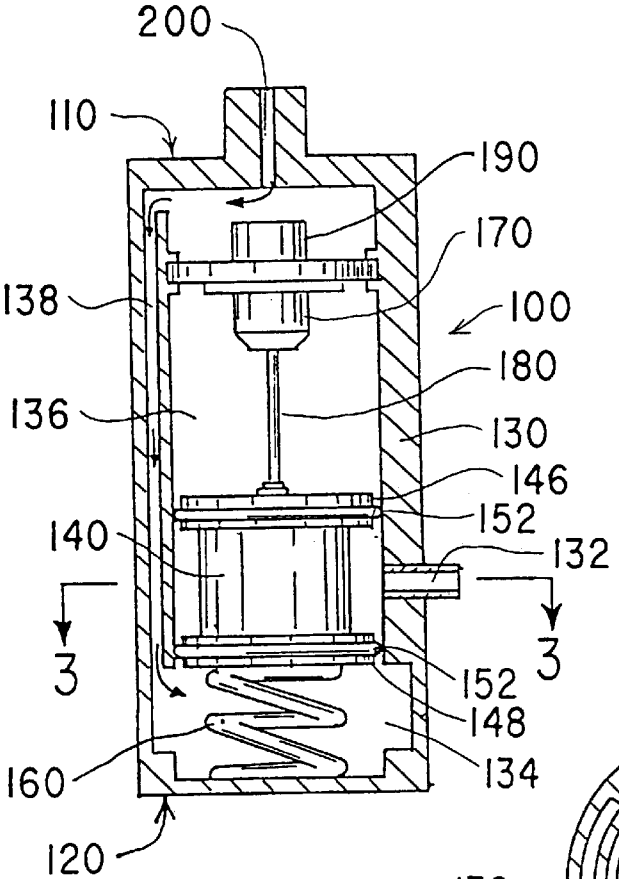
FIG. 1 is a detail view, partly in cross section, of one embodiment of a valve in a drip valve installation of the present invention, shown in a closed position.

FIGS. 1–3 show a second embodiment of the valve, again in a drip valve installment. In this embodiment, the temperature sensor 190 is sealed within the narrow diameter section 136 of the internal cavity near the supply conduit 200. The large diameter section 134 of the cavity is located proximate the core bottom 120 and the output port 132 is located within the sidewall 130 of the narrow diameter section 135 adjacent the large diameter section 134. A passageway 138, defined within the sidewall 130 of the core 100, fluidly connects the sealed portion of the narrow diameter section 135 containing the temperature sensor 190 with the large diameter section 134. Fluid enters the valve by the supply conduit 200, travels into a sealed narrow diameter chamber containing the temperature sensor 190 through the passageway 138 to the large diameter section 134 where it remains until said piston is moved to the second extended position. Once in the extended position the second sealing disc 148 enters the large diameter section 134 thus allowing fluid to pass around the piston to exit through the output port 132.

Figure 7:
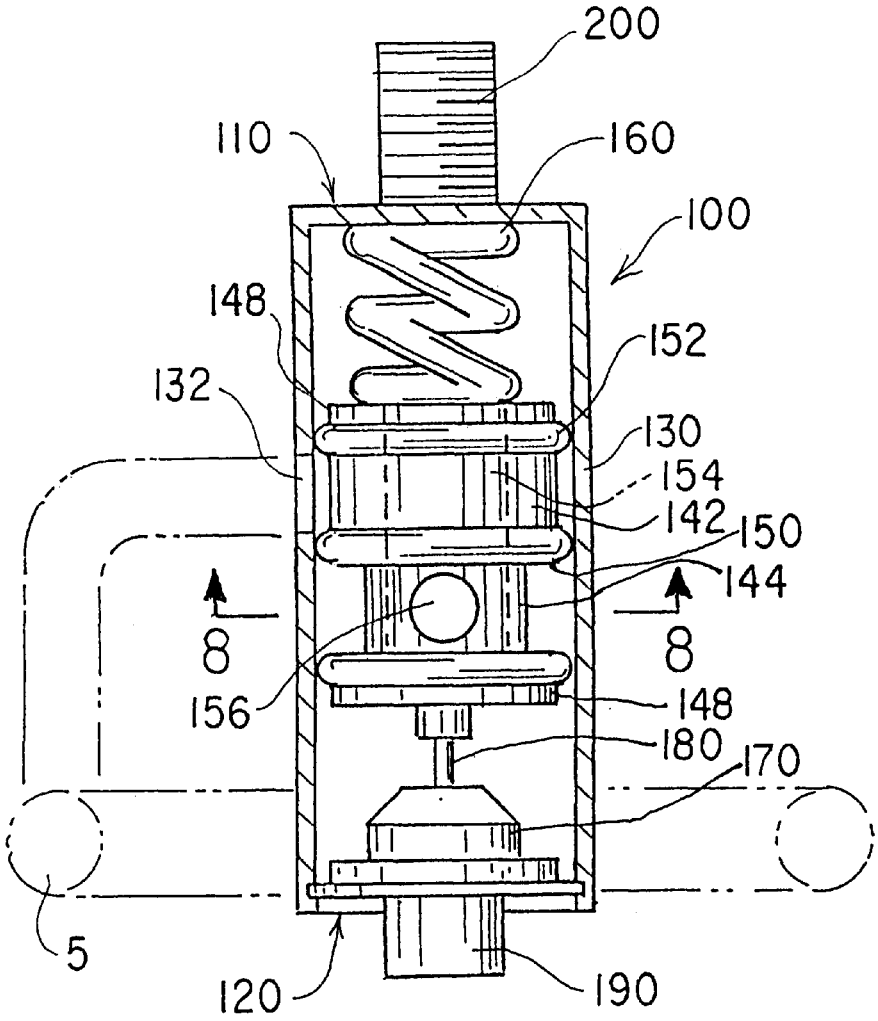
FIG. 7 is a detail view, partly in cross section, of an alternative valve used in a sprinkler installation of the present invention, shown in a closed position.
Figure 8:
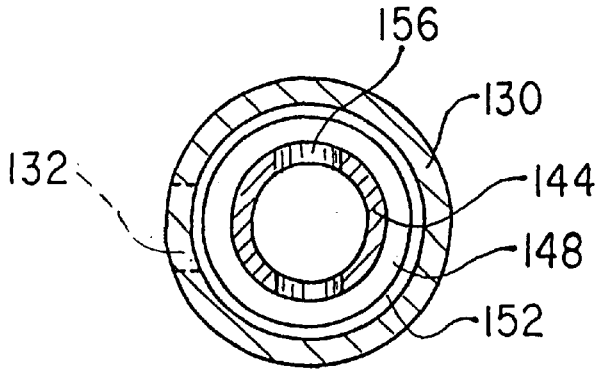
FIG. 8 is a plan cross sectional view taken along line 8—8 of FIG. 7.

FIG. 7 shows yet another embodiment of the valve in a sprinkler arrangement. This valve has a core 100 defining an internal cavity having a single diameter throughout. The piston main body 140 is separated into two sections. The piston has opposed ends, each defining a sealing disc. A first sealing disc 146 is located at the end of the first section 142 of the piston while a second sealing disc 148 is found at the end of the second section 144 of the piston. A third sealing disc 150 is located between the first 142 and second section 144. A rubber O-ring 152 is again used on each sealing disc to ensure the formation of a seal. An internal channel 154 is defined by the piston. The passageway 138 opens at the end of the first section 142, passes through that section and into the second section 144 of the piston. In the second section 144, the channel 154 defines at least one exit hole 156 through the side wall of the piston. The valve is closed when in a retracted position; the output port 132 being sealed between the second and third sealing discs 150. When the piston is in an extended position, the exit hole 156 of the second section 144 of the piston is aligned with the output port 132 of the core 100. Fluid, then, flows through the supply conduit 200 into the core cavity, into the channel 154 of the piston, through the exit holes 156 of the second section 144 of the piston and through the output port 132 in the sidewall 130 of the core 100. The output may be connected to a sprinkler head as shown in FIG. 7.

It is important to note that this embodiment may be converted for use in a drip valve installment by enclosing the temperature sensor 190 in-line with the fluid flow for sensing the temperature of the fluid within the system. Likewise, the previous embodiments may be incorporated into a sprinkler system by removing the temperature sensor 190 from the fluid flow, and exposing it to the ambient air.

It is to be understood that the present invention is not limited to the embodiments described above, but encompasses any and all embodiments within the scope of the following claims.

I claim:

1. A temperature sensitive valve for controlling the flow of a fluid in a fluid system, said valve comprising:

a cylindrical core, said core including a core top, a core bottom, and a vertical core sidewall therebetween thus defining a cylindrical cavity therein, said cylindrical cavity being dimensioned and configured to include a large diameter section and a narrow diameter section, said sidewall including an outlet port and defining a bypass channel fluidly connecting said upper portion of said narrow diameter section with said large diameter section, wherein said large diameter section is proximate said core bottom, said outlet port is located in said sidewall in said narrow diameter section adjacent said large diameter section;

a fluid supply conduit extending through said core top and in communication with said cavity;

a piston slidably mounted within said cavity, said piston including a main piston body, at least two sealing discs including a first sealing disc and a second sealing disc, each of said sealing discs having an external diameter substantially equal to said narrow diameter, such that when said piston is in a first retracted position, each of said sealing discs engage said narrow diameter section on either side of said outlet port thereby sealing said outlet port against fluid flow and when said piston is in a second extended position, one of said sealing discs disengages said narrow diameter section and enters said large diameter section thereby allowing fluid to pass thereabout and through said outlet port;

a temperature sensor and a motor activated when the temperature is outside a predetermined range, wherein said temperature sensor is mounted within said chamber proximate said core top and said supply conduit, said sensor being sealed in an upper portion of said narrow diameter section for sensing the temperature of fluid within the system;

an activating rod having two ends, a first end attached to said first sealing disc and a second end coupled to said sensor motor for oscillation of said rod and thus said piston between said first retracted position and said second extended position when said motor is activated;

whereby fluid is held in said large diameter section by said second sealing disc when said piston is in said first retracted position and fluid enters said narrow diameter section and flows through said outlet port when said motor is activated, moving said piston to said second extended position where said second sealing disc of said piston disengages said sidewall of said narrow diameter section and enters said large diameter section.

2. The valve as recited in claim 1, wherein a compression spring disposed within said cavity biases said piston in said first retracted position.

* * * * *